US007533440B2

(12) United States Patent
Paterson et al.

(10) Patent No.: US 7,533,440 B2
(45) Date of Patent: May 19, 2009

(54) INTEGRAL VACUUM CLEANER BUMPER

(75) Inventors: Christopher M. Paterson, Biloxi, MS (US); James Chisholm, Bay Saint Louis, MS (US); Bruce M. Kiern, Gulfport, MS (US)

(73) Assignee: Oreck Holdings, LLC, Cheyenne, WY (US)

( * ) Notice: Subject to any disclaimer, the term of this patent is extended or adjusted under 35 U.S.C. 154(b) by 665 days.

(21) Appl. No.: 10/818,728

(22) Filed: Apr. 6, 2004

(65) Prior Publication Data

US 2005/0217063 A1 Oct. 6, 2005

(51) Int. Cl.
*A47L 5/00* (2006.01)

(52) U.S. Cl. ..... 15/325; 15/246.2; 209/215

(58) Field of Classification Search ..... 15/325, 15/339, 246.2; 209/215; *A47L 5/00*
See application file for complete search history.

(56) References Cited

U.S. PATENT DOCUMENTS

| | | | | |
|---|---|---|---|---|
| 2,288,115 | A * | 6/1942 | Soldanels | 15/339 |
| 2,677,461 | A * | 5/1954 | Bodey | 209/215 |
| 2,847,084 | A * | 8/1958 | Wolfskill et al. | 96/416 |
| 4,279,745 | A | 7/1981 | Haase | |
| 4,300,260 | A | 11/1981 | Hill | |
| 4,407,038 | A | 10/1983 | Haase | |
| 4,598,439 | A | 7/1986 | Good | |
| 4,759,095 | A | 7/1988 | Hoy, Jr. | |
| 4,904,376 | A | 2/1990 | Haase | |
| 5,052,074 | A | 10/1991 | Korsen | |
| 5,179,756 | A | 1/1993 | Korsen | |
| 5,271,119 | A | 12/1993 | Myers et al. | |
| 5,285,904 | A | 2/1994 | Haase | |
| 5,819,368 | A | 10/1998 | Wang et al. | |
| 6,341,403 | B1 | 1/2002 | Strickrodt et al. | |
| 2006/0090287 | A1 * | 5/2006 | Genoa et al. | 15/325 |

FOREIGN PATENT DOCUMENTS

| | | | |
|---|---|---|---|
| DE | 69 19 724 | U | 1/1970 |
| DE | 87 11 295 | U1 | 2/1988 |
| FR | 2 729 289 | A | 7/1996 |
| JP | 02305533 | A * | 12/1990 |
| JP | 11009516 | | 1/1999 |

* cited by examiner

*Primary Examiner*—David A Redding
(74) *Attorney, Agent, or Firm*—Winston & Strawn LLP; Richard P. Gilly

(57) ABSTRACT

An integral vacuum cleaner bumper is provided according to an embodiment of the invention. The bumper includes a bumper shell formed of an at least partially resilient material and includes an inner surface that mates to the vacuum cleaner chassis and an outer surface. The bumper shell is affixed to the vacuum cleaner chassis as an integral component of the vacuum cleaner and the outer surface of the bumper shell becomes a portion of an outer surface of the vacuum cleaner. The bumper further includes one or more cavities formed along a bottom edge region of the bumper shell, one or more corresponding magnets designed to fit into the one or more cavities, a backing plate including one or more fastener apertures, and one or more fasteners that pass through the one or more fastener apertures of the backing plate and affix the backing plate to the bumper shell.

12 Claims, 7 Drawing Sheets

SECTION

SECTION

SECTION

INTEGRAL VACUUM CLEANER BUMPER

TECHNICAL FIELD

The present invention relates to a vacuum cleaner bumper, and more specifically, an integral vacuum cleaner bumper adapted to be affixed to a vacuum cleaner chassis of a vacuum cleaner.

BACKGROUND OF THE INVENTION

Vacuum cleaners are widely used for picking up dust and debris. In use, a vacuum cleaner can encounter many types of dirt and debris, including metallic objects. For example, a vacuum cleaner can encounter relatively large metallic objects such as screws, nails, staples, etc. Such large objects may be difficult to pick up in the vacuum airflow. In addition, such objects can cause other problems if dislodged or picked up by the vacuum cleaner. For example, picked up metallic objects can cause blockage of the vacuum airflow or can cause impact damage to vacuum cleaner components. In addition, such objects can be thrown outward if the vacuum cleaner includes a rotating brushroll. Moreover, the movement of such objects can cause objectionable noise.

In one common prior art approach, a magnet is attached to the front of a vacuum cleaner by a frame or holder. As a result, the frame/holder and magnet extend out in front of the vacuum cleaner. This is usually an add-on device that can be added to and removed from the vacuum cleaner by the user.

However, this prior art approach has several drawbacks. This prior art approach is not an integral part of the vacuum cleaner, and the magnet and frame are not within the profile of the vacuum cleaner. As a result, a significant drawback is that the vacuum cleaner nozzle and brushroll are prevented from getting close to walls, furniture, etc., by the outwardly extending magnet and frame. The add-on nature of the prior art magnet devices (using straps in some cases) means that they are not fixedly held to the vacuum cleaner, and consequently can slip, twist, etc. Some examples of this prior art approach are even designed to contact or drag on the underlying surface. Contact between the magnet device and the underlying surface can result in the vacuum cleaner pushing any attracted metallic objects against the underlying surface and causing scratching and other damage to the underlying surface. In addition, this prior art approach is unsightly. Moreover, this prior art approach can cause difficulty in transporting and maneuvering the vacuum cleaner.

Another prior art approach has been to screw or clamp a magnet to the bottom surface of the vacuum cleaner. This approach also presents significant drawbacks. The magnet still extends from the vacuum cleaner in some manner, and is not within the profile of the vacuum cleaner. The magnet reduces the clearance of the vacuum cleaner as determined by the wheels and/or rollers of the vacuum cleaner. In addition, the magnet can impede or divert the vacuum airflow. Moreover, having a magnet extend from the bottom surface provides an increased risk of damage to an underlying surface during movement of the vacuum cleaner. This is especially true when metallic objects are clinging to the magnet.

SUMMARY OF THE INVENTION

An integral vacuum cleaner bumper adapted to be affixed to a vacuum cleaner chassis of a vacuum cleaner is provided according to an embodiment of the invention. The bumper comprises a bumper shell formed of an at least partially resilient material and includes an inner surface that mates to the vacuum cleaner chassis and an outer surface. The bumper shell is adapted to be affixed to the vacuum cleaner chassis as an integral component of the vacuum cleaner and wherein the outer surface of the bumper shell becomes a portion of an outer surface of the vacuum cleaner. The bumper further comprises one or more cavities formed in the inner surface of the bumper shell and formed along a bottom edge region of the bumper shell. The bumper further comprises one or more corresponding magnets designed to fit at least partially into the one or more cavities. The bumper further comprises a backing plate including one or more fastener apertures. The bumper further comprises one or more fasteners that pass through the one or more fastener apertures of the backing plate and affix the backing plate to the bumper shell. The one or more magnets are trapped in the one or more cavities by the backing plate.

An integral vacuum cleaner bumper adapted to be affixed to a vacuum cleaner chassis of a vacuum cleaner is provided according to an embodiment of the invention. The bumper comprises a bumper shell formed of an at least partially resilient material and includes an inner surface that mates to the vacuum cleaner chassis and an outer surface. The bumper shell is adapted to be affixed to the vacuum cleaner chassis as an integral component of the vacuum cleaner and wherein the outer surface of the bumper shell becomes a portion of an outer surface of the vacuum cleaner. The bumper further comprises one or more magnets cast into the bumper shell.

An integral vacuum cleaner bumper adapted to be affixed to a vacuum cleaner chassis of a vacuum cleaner is provided according to an embodiment of the invention. The bumper comprises a bumper shell formed of an at least partially resilient material and includes an inner surface that mates to the vacuum cleaner chassis and an outer surface. The bumper shell is adapted to be affixed to the vacuum cleaner chassis as an integral component of the vacuum cleaner and wherein the outer surface of the bumper shell becomes a portion of an outer surface of the vacuum cleaner. The bumper further comprises a magnet receptacle formed in a bottom edge region of the bumper shell. The bumper further comprises an air channel formed in the bumper shell and adapted to conduct airflow from the bottom edge region to an air channel of the vacuum cleaner. The bumper further comprises one or more magnets configured to be retained in the magnet receptacle.

BRIEF DESCRIPTION OF THE DRAWINGS

The same reference number represents the same element on all drawings. It should be noted that the drawings are not to scale.

DETAILED DESCRIPTION OF THE INVENTION

Figure 1:
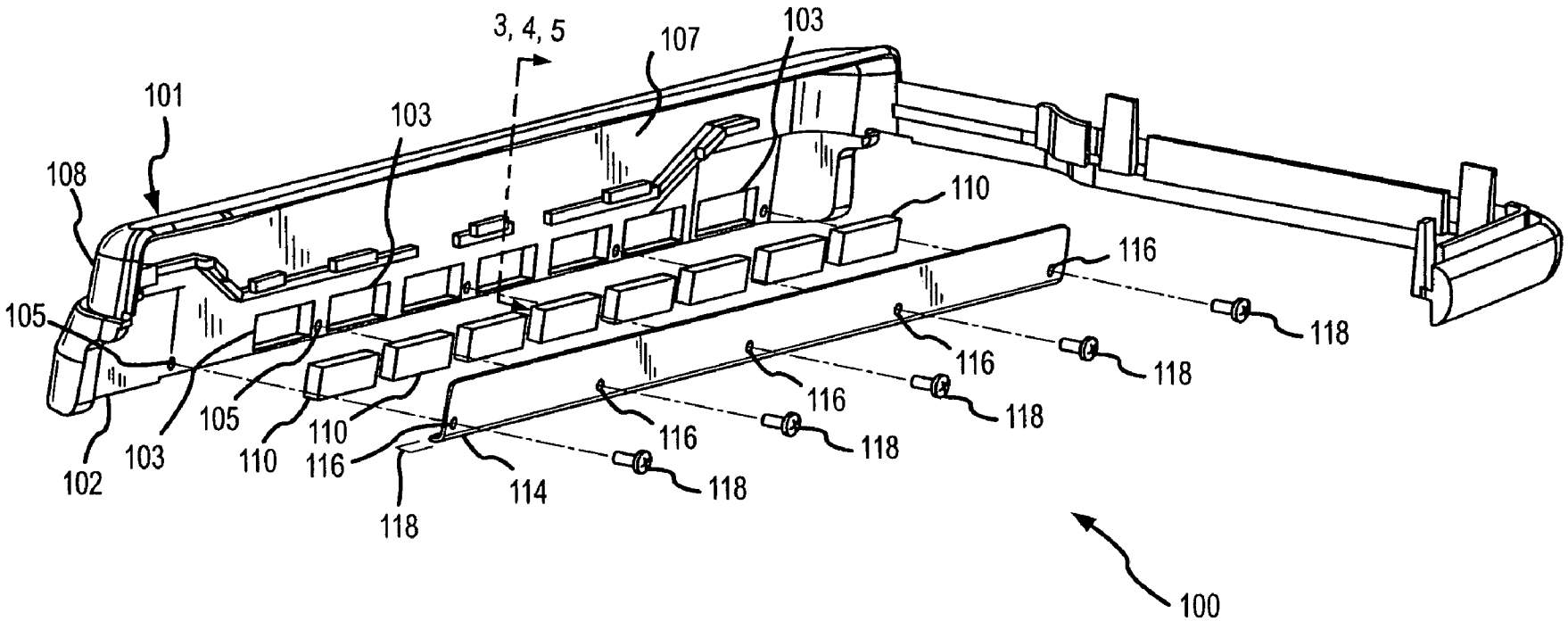
FIG. 1 shows an integral vacuum cleaner bumper according to an embodiment of the invention.

FIG. 1 shows an integral vacuum cleaner bumper 100 according to an embodiment of the invention. The integral vacuum cleaner bumper 100 includes a bumper shell 101, one or more magnets 110, and a backing plate 114. The bumper shell 101 further includes an inner surface 107, an outer surface 108, and one or more cavities 103 formed along a bottom edge region 102 of the bumper shell 101 and corresponding to the one or more magnets 110. The bumper shell 101 can include fastener apertures 105 and the backing plate 114 can include corresponding fastener apertures 116.

When the integral vacuum cleaner bumper 100 is fully assembled, the one or more magnets 110 fit at least partially into the one or more cavities 103 in the bumper shell 101. The backing plate 114 is held to the bumper shell 101 by fasteners 118, which pass through the fastener apertures 116 in the backing plate 114 and removably affix the backing plate 114 to the bumper shell 101. The fasteners 118 can engage the fastener apertures 105 in the bumper shell 101. The fastener apertures 105 can be blind bores, for example. As a result, the one or more magnets 110 are trapped in the one or more cavities 103 by the backing plate 114.

Figure 2:
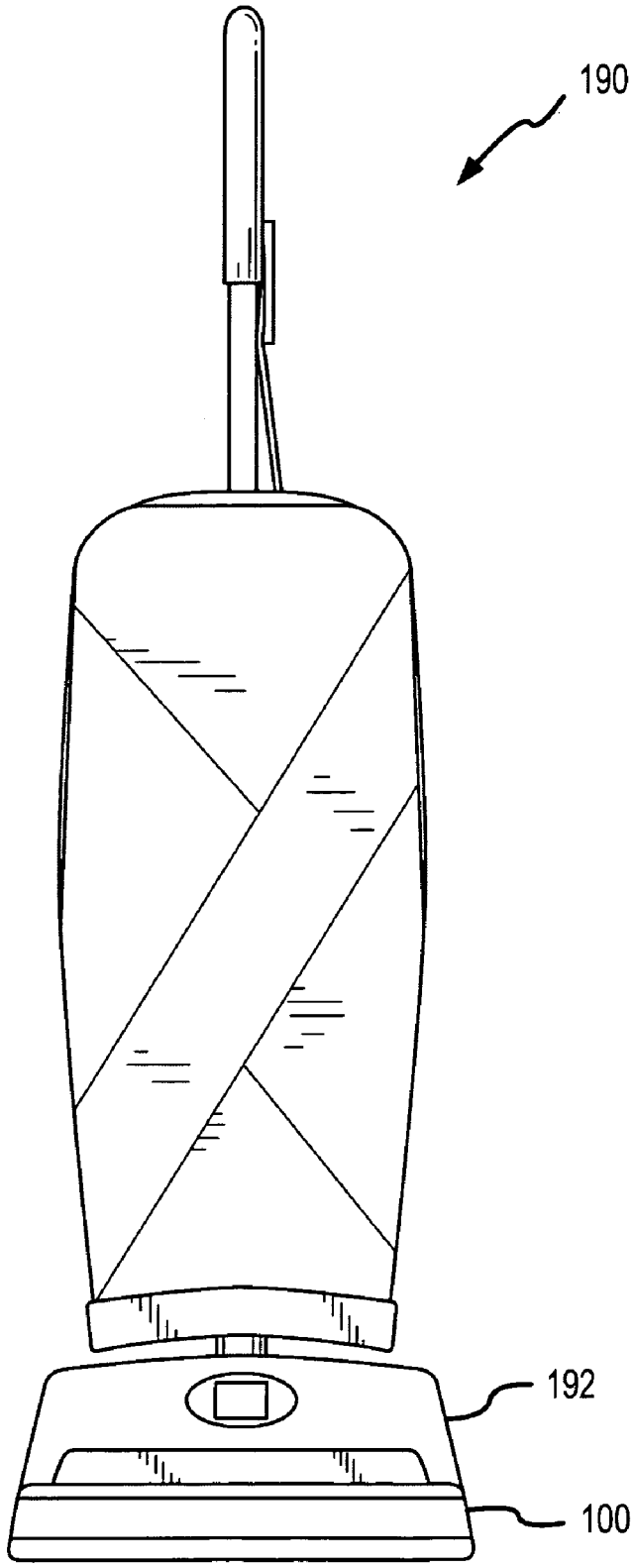
FIG. 2 is an elevation view of a vacuum cleaner including the integral vacuum cleaner bumper according to an embodiment of the invention.

The integral vacuum cleaner bumper 100 can be assembled to a vacuum cleaner 190 (see FIG. 2). The bumper shell 101 can be affixed to the vacuum cleaner chassis 192 as an integral component of the vacuum cleaner 190 and forms a portion of an outer surface of the vacuum cleaner 190.

The bumper shell 101 can comprise an at least partially resilient portion and can be formed of a resilient or flexible material. Consequently, the bumper shell 101 can deform when an obstacle is contacted. The integral vacuum cleaner bumper 100 therefore prevents damage to both the vacuum cleaner 190 and to the contacted obstacle.

The bumper shell 101 extends at least partially along a side of the vacuum cleaner 190. For example, the integral vacuum cleaner bumper 100/bumper shell 101 in one embodiment extends across a front region of the vacuum cleaner 190. Alternatively, the integral vacuum cleaner bumper 100 in another embodiment can extend across side regions or a back region. In yet another embodiment, the integral vacuum cleaner bumper 100 can extend across two or more of the front, side, and back regions.

The backing plate 114 in one embodiment comprises a metallic strip. The metallic strip can conduct a magnetic field generated by the one or more magnets 110. Alternatively, the backing plate 114 can comprise a magnetic material that generates a magnetic field. In either embodiment, the backing plate 114 can provide a substantially uniform magnetic field when assembled to the one or more magnets 110. In addition, the backing plate 114 can provide additional strength to the bumper shell 101.

In one embodiment, the backing plate 114 can include a lip 119. The lip 119 can receive a lower portion of the magnets 110 and can assist in retaining the one or more magnets 110 (see FIG. 4).

The fasteners 116 in one embodiment can comprise screws and the fastener apertures 105 can comprise blind bores, for example. Alternatively, the fasteners 116 can comprise rivets, barbs, clips, etc. The fasteners 116 can comprise devices that frictionally engage the fastener apertures 105 in the bumper shell 101. The fasteners 116 can comprise devices that provide a biasing force against the bumper shell 101. The fasteners 16 can removably or substantially permanently affix the backing plate 114 to the bumper shell 101.

Alternatively, in other embodiments, the backing plate 114 is not required. For example, in one embodiment, the one or more magnets 110 can be retained in the one or more cavities 103 by some manner of adhesive. In another alternative embodiment, the one or more magnets 110 can be retained in the one or more cavities 103 by the vacuum cleaner chassis 192 when the integral vacuum cleaner bumper 100 is assembled to the chassis 192. In yet another alternative embodiment, the one or more magnets 110 can be simply cast in the bumper shell 101 (see FIG. 5 and the accompanying discussion).

The size and location of the magnets 110 in the bumper shell 101 can be determined by the magnetic strength of the magnets. Stronger magnets can be positioned farther from the bottom edge region 102. Likewise, the distance of a magnet 110 from a front surface 104 (see FIG. 3) can also be varied in order to obtain a desired magnetic field strength radiating out in front of the vacuum cleaner 190.

In one embodiment, the one or more magnets 110 comprise one or more permanent magnets. For example, the one or more magnets 110 can be formed of a magnetic ferrous material, of a magnetic ceramic material, etc.

In another embodiment, the one or more magnets 110 comprise one or more electromagnets. An electromagnet generally comprises an iron core surrounded by wire windings. The core can comprise any desired shape, such as a rod, a bar, a U-shape, etc. An electrical current through the windings generates a magnetic field. In an electromagnet, the strength of the magnetic field is determined by factors such as the composition of the core, the number of windings, and the amount of electrical current flowing through the windings. In one embodiment, the electrical current for the one or more electromagnets 110 is obtained from the vacuum cleaner. The electrical current can be derived directly from electrical current being supplied to the vacuum cleaner, or can be controlled by a switch or device that can be regulated by a user of the vacuum cleaner.

FIG. 2 is an elevation view of a vacuum cleaner 190 including the integral vacuum cleaner bumper 100 according to an embodiment of the invention. It can be seen from the figure that the integral vacuum cleaner bumper 100 conforms to and is a part of the profile of the vacuum cleaner 190. The figure shows the integral vacuum cleaner bumper 100 extending fully across a front region of the vacuum cleaner 190. It should be understood that the integral vacuum cleaner bumper 100 can extend partially or fully across the front region, the side regions, or the back regions of the vacuum cleaner 190. Alternatively, the integral vacuum cleaner bumper 100 can extend across more that one of the front, side, and back regions.

Figure 3:
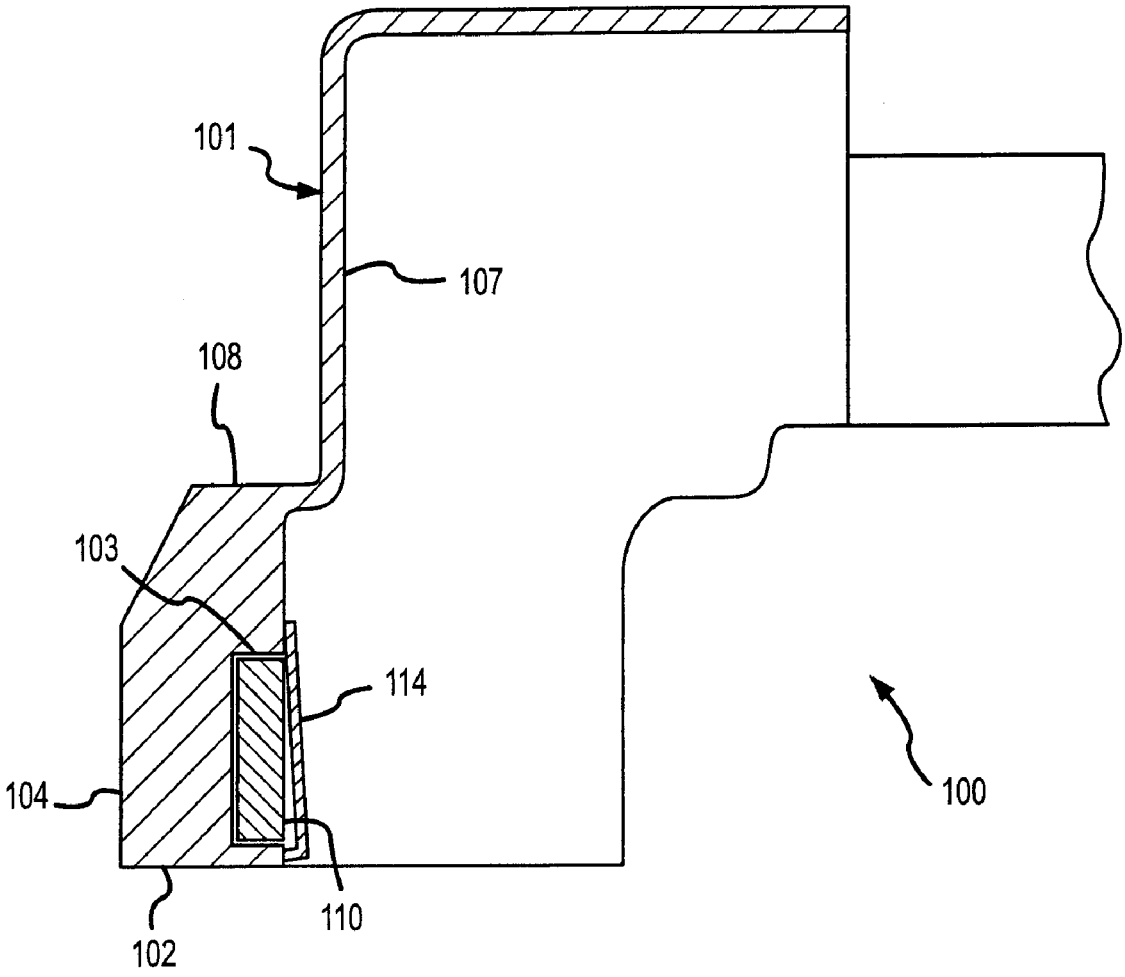
FIG. 3 is a section view of the integral vacuum cleaner bumper along the section line AA of FIG. 1.

FIG. 3 is a section view of the integral vacuum cleaner bumper 100 along the section line AA of FIG. 1. This figure shows a magnet 110 (of one or more magnets) substantially inside one corresponding cavity 103. The backing plate 114 blocks the cavity 103 and as a result traps the magnet 110 in the cavity 103. The fasteners 118 are not shown for clarity.

Figure 4:
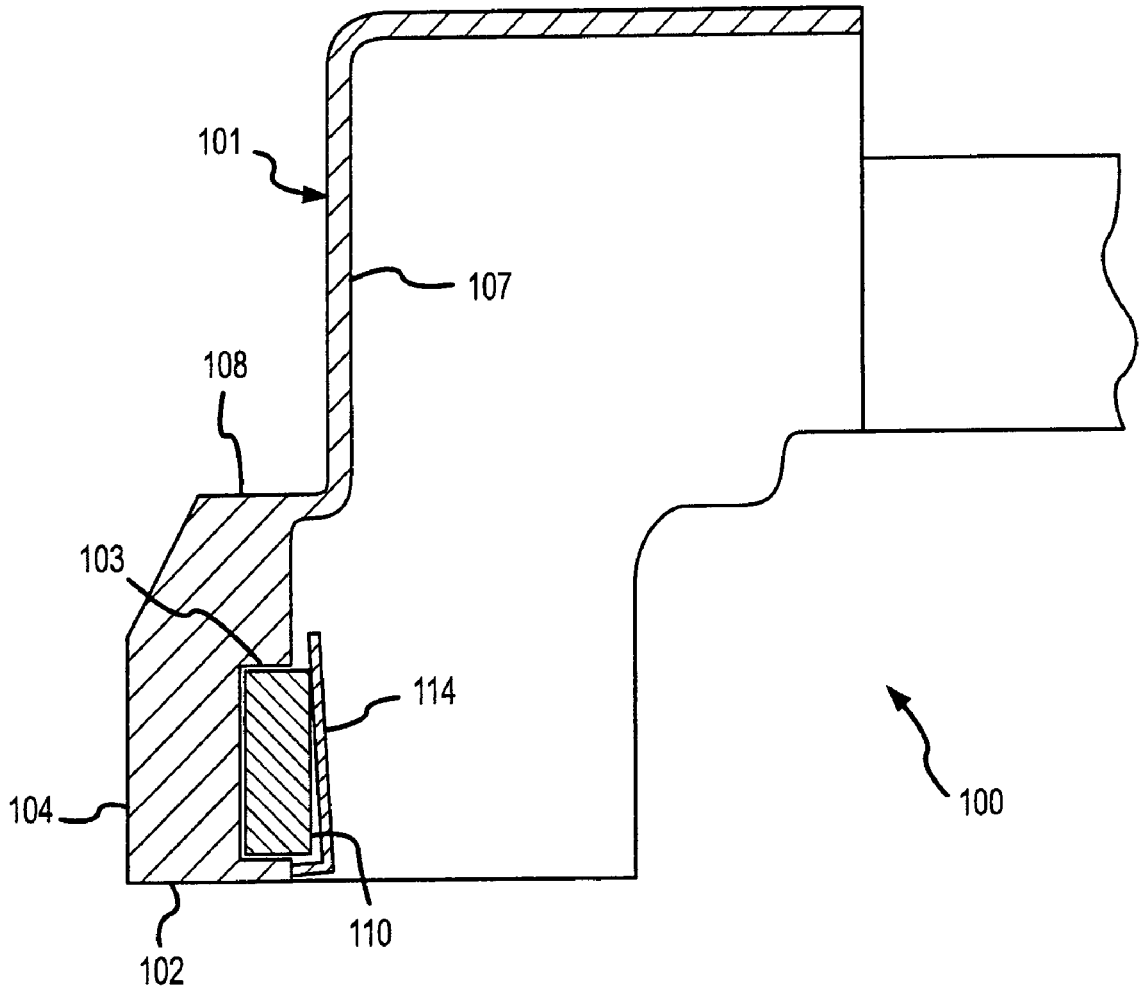
FIG. 4 is another section view of the integral vacuum cleaner bumper along the section line AA of FIG. 1.

FIG. 4 is another section view of the integral vacuum cleaner bumper 100 along the section line AA of FIG. 1. This figure shows one magnet 110 residing only partially inside one corresponding cavity 103. The backing plate 114 still blocks the cavity 103 and as a result traps the magnet 110 in the cavity 103.

Figure 5:
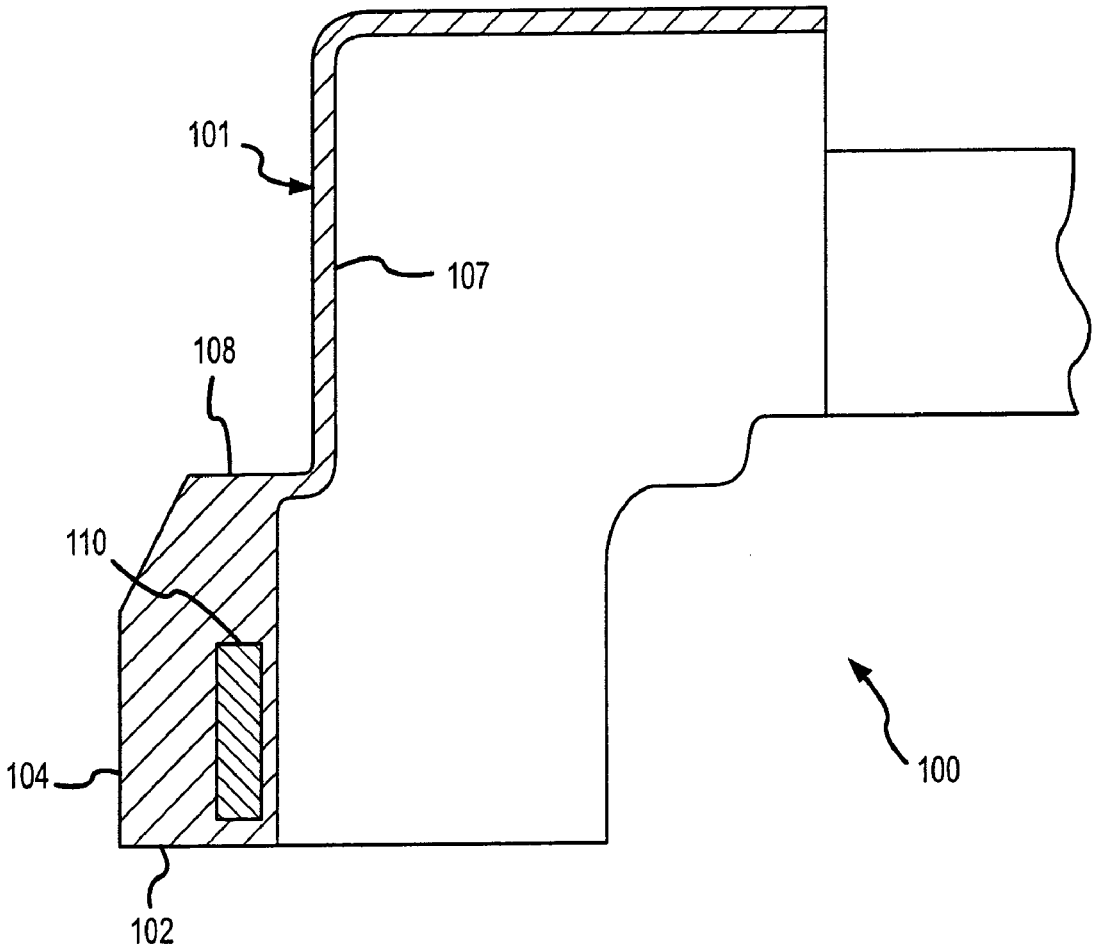
FIG. 5 is yet another section view of the integral vacuum cleaner bumper along the section line AA of FIG. 1.

FIG. 5 is yet another section view of the integral vacuum cleaner bumper 100 along the section line AA of FIG. 1. This embodiment includes one or more magnets 110 embedded within the bumper shell 101. The magnets 110 can be cast within the bumper shell 101, such as during formation of the bumper shell 101, for example. The bumper shell 101 can be formed by injection molding, for example, and the one or more magnets 110 can therefore be formed as part of the bumper shell 101. In this embodiment, the backing plate 114 is not required, and can be omitted. However, the backing plate 114 can optionally be included in order to form a stronger and/or more continuous magnetic field.

Figure 6:
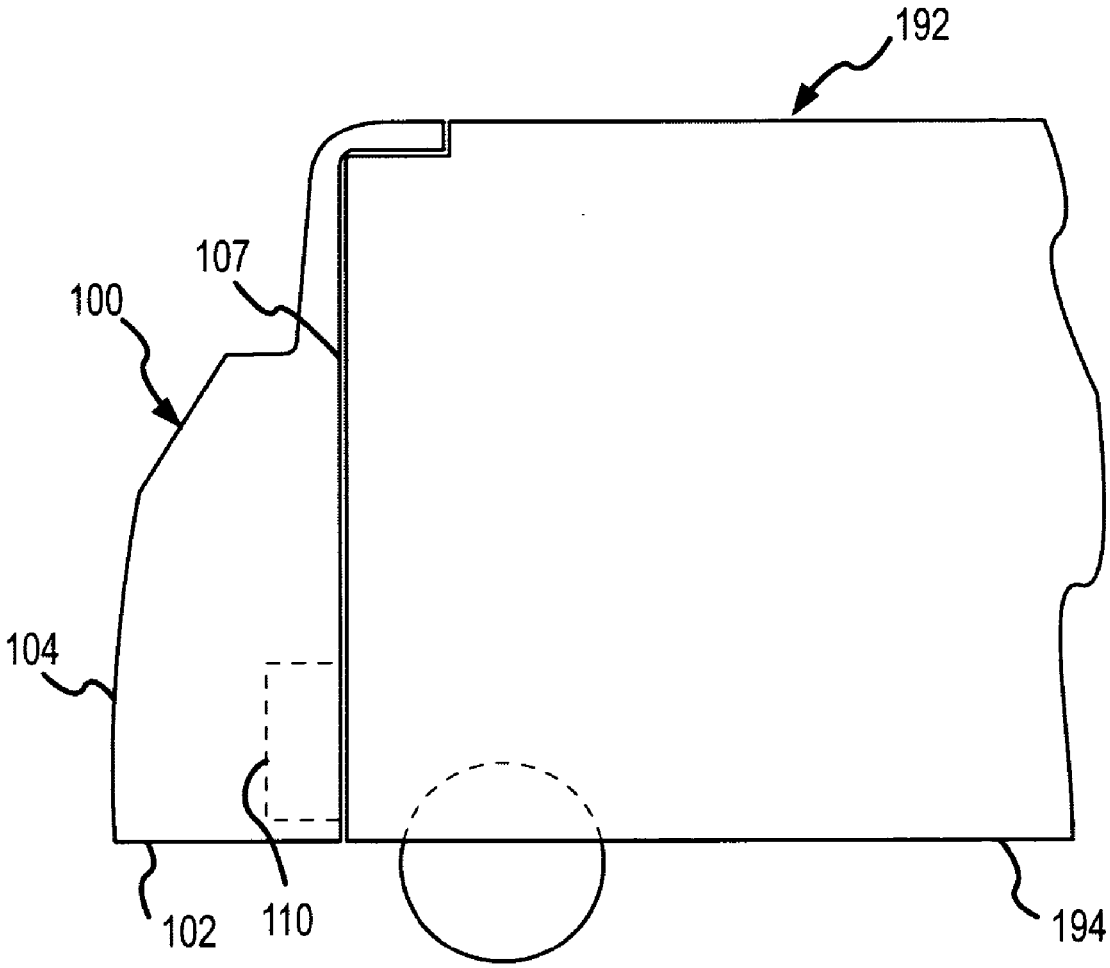
FIG. 6 shows the integral vacuum cleaner bumper assembled to a vacuum cleaner chassis.

FIG. 6 shows the integral vacuum cleaner bumper 100 assembled to a vacuum cleaner chassis 192. It should be understood that the figure is not to scale. It can again be seen that the integral vacuum cleaner bumper 100 fits to the vacuum cleaner chassis 190 and therefore conforms to and forms part of the profile of the vacuum cleaner 190. In one embodiment, when thus assembled, the bottom edge region 102 of the integral vacuum cleaner bumper 100 is substantially even with a bottom surface 194 of the vacuum cleaner chassis 192, as shown. Alternatively, the bottom edge region 102 can be higher that the bottom surface 194 so that the integral vacuum cleaner bumper 100 does not contact objects on the underlying surface (a skidplate on the vacuum cleaner is desirably the first point of contact).

Figure 7:
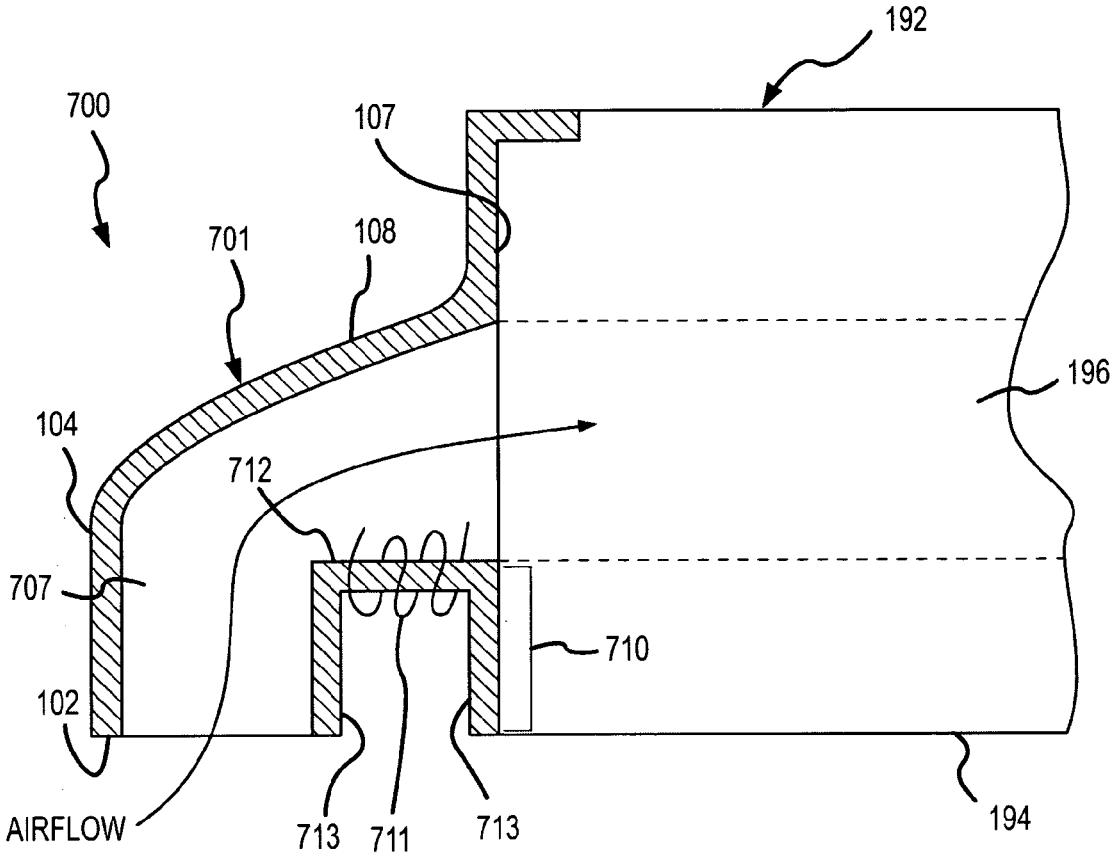
FIG. 7 shows an integral vacuum cleaner bumper according to another embodiment of the invention.

FIG. 7 shows an integral vacuum cleaner bumper 700 according to another embodiment of the invention. As before, the integral vacuum cleaner bumper 700 includes a bumper shell 701 and one or more magnets 710. In this embodiment, the integral vacuum cleaner bumper 700 includes an air channel 707 formed in the bumper shell 701. At least a portion of the vacuum airflow generated by the vacuum cleaner 190 flows through the air channel 707, and as a result the air channel 707 conducts airflow from the bottom edge region 102 of the bumper shell 701 to an air channel 196 of the vacuum cleaner 190. The bumper shell 701 includes a magnet receptacle 720. The one or more magnets 710 are retained in the magnet receptacle 720. The magnet 710 can be held in the bumper shell 701 in any manner, such as by fasteners, by friction or snap fittings, retaining lips or channels, adhesives, etc. As in the previous embodiments, the integral vacuum cleaner bumper 700 fits to the vacuum cleaner chassis 192 and forms part of the profile of the vacuum cleaner 190.

The one or more magnets 710 can comprise permanent magnets, as previously shown and discussed. Alternatively, as shown in this figure, the one or more magnets 710 can comprise one or more electromagnets. In one embodiment, the one or more magnets 710 comprise a single U-shaped magnet 710, wherein a coil 711 is wound around a central portion 712 and the legs 713 comprise the main magnet portions. However, other shapes can be employed. The vacuum airflow through the air channel 707 flows over at least a portion of the one or more magnets 710.

The various embodiments of the invention can be implemented to provide several advantages, if desired. The integral vacuum cleaner bumper 100 can pick up metallic objects, such as metallic objects that are in the path of the vacuum cleaner 190. The integral vacuum cleaner bumper 100 therefore can remove metallic objects in advance of the vacuum cleaner 190, before such objects encounter a nozzle or brushroll. The integral vacuum cleaner bumper 100 can include magnets on any side of the vacuum cleaner 190.

Another advantage is that the integral vacuum cleaner bumper 100 and magnets are an integral part of and are constructed within the profile of the vacuum cleaner 190. The integral vacuum cleaner bumper 100 therefore does not extend out in front of the vacuum cleaner 190 and does not contact the underlying surface. As a result, the integral vacuum cleaner bumper 100 according to any embodiment of the invention does not interfere with the ability of the vacuum cleaner 190 to reach all areas of the floor, including floor areas near walls or obstacles. In addition, the integral vacuum cleaner bumper 100 does not reduce the floor clearance of the vacuum cleaner 190. The integral vacuum cleaner bumper 100 therefore does not interfere with the pickup ability of the vacuum cleaner 190.

The integral vacuum cleaner bumper 100 provides magnets wherein the magnets are not exposed, and wherein attracted metallic objects can be easily brushed off of the integral vacuum cleaner bumper 100. In an electromagnet embodiment, cleanup of accumulated metallic objects is as simple as turning off power to the one or more electromagnets.

What is claimed is:

1. An integral vacuum cleaner bumper adapted to be affixed to a vacuum cleaner chassis of a vacuum cleaner, the bumper comprising:

a bumper shell formed of an at least partially resilient material and including an inner surface that mates to the vacuum cleaner chassis and an outer surface, wherein the bumper shell is adapted to be affixed to the vacuum cleaner chassis as an integral component of the vacuum cleaner and wherein the outer surface of the bumper shell becomes a portion of an outer surface of the vacuum cleaner;

one or more cavities formed in the inner surface of the bumper shell and formed along a bottom edge region of the bumper shell;

one or more corresponding magnets designed to fit at least partially into the one or more cavities;

a backing plate including one or more fastener apertures; and one or more fasteners that pass through the one or more fastener apertures of the backing plate and affix the backing plate to the bumper shell, wherein the one or more magnets are trapped in the one or more cavities by the backing plate.

2. The integral vacuum cleaner bumper of claim 1, wherein the bumper shell is substantially rigidly affixed to the vacuum cleaner chassis.

3. The integral vacuum cleaner bumper of claim 1, wherein a bottom edge region of the bumper is substantially even with a bottom surface of the vacuum cleaner chassis.

4. The integral vacuum cleaner bumper of claim 1, with the one or more magnets comprising one or more permanent magnets.

5. The integral vacuum cleaner bumper of claim 1, with the one or more magnets comprising one or more electromagnets.

6. The integral vacuum cleaner bumper of claim 1, wherein the backing plate conducts a magnetic field and provides a substantially uniform magnetic field when assembled to the one or more magnets.

7. The integral vacuum cleaner bumper of claim 1, wherein the backing plate is at least partially magnetic and provides a substantially uniform magnetic field when assembled to the one or more magnets.

8. An integral vacuum cleaner bumper adapted to be affixed to a vacuum cleaner chassis of a vacuum cleaner, the bumper comprising;

a bumper shell formed of an at least partially resilient material and including an inner surface that mates to the vacuum cleaner chassis and an outer surface, wherein the bumper shell is adapted to be affixed to the vacuum cleaner chassis as an integral component of the vacuum cleaner and wherein the outer surface of the bumper shell becomes a portion of an outer surface of the vacuum cleaner;

a magnet receptacle formed in a bottom edge region of the bumper shell;

an air channel formed in the bumper shell and adapted to conduct airflow from the bottom edge region to an air channel of the vacuum cleaner; and one or more magnets configured to be retained in the magnet receptacle.

9. The integral vacuum cleaner bumper of claim 8, wherein the bumper shell is substantially rigidly affixed to the vacuum cleaner chassis.

10. The integral vacuum cleaner bumper of claim 8, wherein the bottom edge region of the bumper is substantially even with a bottom surface of the vacuum cleaner chassis.

11. The integral vacuum cleaner bumper of claim 8, with the one or more magnets comprising one or more permanent magnets.

12. The integral vacuum cleaner bumper of claim 8, with the one or more magnets comprising one or more electromagnets.

* * * * *